United States Patent [19]

Minor et al.

[11] 4,170,199

[45] Oct. 9, 1979

[54] CLOSED HEAT TRANSFER SYSTEM

[75] Inventors: Robert N. Minor, Stafford Springs; Roger M. Metivier, Manchester, both of Conn.

[73] Assignee: Regor Energy Saver Inc., Manchester, Conn.

[21] Appl. No.: 908,156

[22] Filed: May 22, 1978

[51] Int. Cl.[2] ..... F22B 1/02; F22B 33/02

[52] U.S. Cl. ..... 122/33; 122/37

[58] Field of Search ..... 122/32, 33, 34, 37, 122/51

[56] References Cited

U.S. PATENT DOCUMENTS

| | | | |
|---|---|---|---|
| 1,604,280 | 10/1926 | Haag | 122/33 |
| 2,791,204 | 5/1957 | Andrus | 122/33 |
| 3,237,608 | 3/1966 | Brandl | 122/33 |
| 3,704,691 | 12/1972 | Brandl | 122/33 |

FOREIGN PATENT DOCUMENTS

| | | | |
|---|---|---|---|
| 1051056 | 9/1953 | France | 122/51 |

*Primary Examiner*—Kenneth W. Sprague

[57] ABSTRACT

A closed heat transfer system which is capable of providing more efficient heat transfer by virtue of the fact that a small fuel burner is operated for a longer period of time but with much less consumption of fuel than compared to a conventional cycled heating system. The system includes a heat sink containing a suitable heat storage fluid, a heat source, heat transfer means, a preheater means, hot water feed means, and circulator means. The heat sink preferably takes the form of a closed container operable in the manner of a boiler and filled with a suitable heat storage fluid.

12 Claims, 2 Drawing Figures

CLOSED HEAT TRANSFER SYSTEM

BACKGROUND OF THE INVENTION (1) Field of the Invention

This invention relates to heat transfer systems, and more particularly to an improvement in heat transfer systems of the type which are operative as heating systems for building structures.

(2) Description of the Prior Art

One of the conventional ways by which building structures have long been heated is through the use of a closed heat transfer system. In accordance therewith, some medium capable of being heated is made to flow in a closed path through the building structure. More specifically, the medium is heated by means of a suitable heat source and is thereafter circulated through the building structure. As the heated medium flows throughout the building structure it gives off its heat, and as a consequence effects a heating of the building structure. Eventually the medium, after giving off a significant amount of its heat, is caused to return to the site of the heat source whereupon the latter once again functions to effect a heating of the medium and the process heretofore described is repeated.

One type of closed heat transfer system which is often to be found employed, particularly in structures that are intended for residential or office use, is that known as a baseboard hot water heating system. Such a system commonly consists of a fluid carrying means through which water is made to circulate, circulating means operative to effect the circulation of the water, and a heat source which is operative to heat the water preparatory to its being circulated through the fluid carrying means. More specifically, the fluid carrying means, the circulating means and the heat source are operatively connected in a closed loop system. Heated water is circulated through the fluid carrying means which commonly takes the form of a system of small diameter piping. This piping, i.e., a multiplicity of interconnected pipes, furthermore is most often provided with means operative to assist in the transfer of heat from the pipes and more specifically the hot water flowing therethrough. Namely, the pipes frequently have fins, etc., operatively associated therewith. The fluid carrying means is located adjacent to the floor of the room to take advantage of the well-known fact that heat rises. Accordingly, the heat being given off by the hot water flowing in the pipes rises from the floor of the room to the ceiling thereof, and in doing so thereby effects a heating of the room.

Conventional closed loop hot water heating systems of the type described above are known to suffer from several disadvantages. For instance, the medium which is heated, commonly in a boiler by a suitable heat source, and the medium which is circulated through the fluid carrying means are normally one in the same, i.e., water. As a consequence, the mode of operation of such systems precludes the use of mediums which are more efficient as a heat sink; namely, mediums which once heated are known to retain their heat more effectively than does water. Secondly, in the course of being circulated through the closed loop heating system, the medium as it passes through the boiler for purposes of becoming heated therein naturally becomes agitated. One consequence of the medium becoming agitated is that a less efficient heating of the medium takes place. Thirdly, in such closed loop heating systems air bubbles are very frequently generated. These air bubbles are most often caused as a result of the operation of the circulating water pump. Frequently the effect of such air bubbles is to cause a disturbing movement to be present in the boiler. Disturbances other than air bubbles are also often generated as the water moves through the long lengths of pipes which the system embodies. The air bubbles and the other disturbances referred to above all function to adversely affect the efficiency of the heating system. Fourthly, such closed loop hot water heating systems are generally characterized by the fact that a significant amount of the heat being generated "goes up the stack" and thus is not being utilized to effect the heating of the structure in which the heating system is employed.

Because of increasing energy costs, there is a need to provide a closed loop hot water heating system which embodies certain features of an advantageous nature. For instance, such a heating system desirably should embody the capability of utilizing different mediums. Namely, the medium being heated in the boiler could be different from the medium being circulated in the piping. The benefit which flows from such a mode of operation is that because no exchange of fluid occurs in the boiler, the medium to be heated in the boiler is not limited to water but rather can be selected on the basis of its ability to serve as a heat sink. Secondly, in such a heating system the fluid in the boiler will stay calm or "dead" thereby obviating the above-discussed inefficiencies of prior closed loop hot water heating systems. Thirdly, the boiler in such an improved closed loop hot water heating system would be further characterized by the fact that no disturbing movement occurs in the boiler stemming from the presence therein of air bubbles.

SUMMARY OF THE INVENTION

In accordance with a preferred form of the invention there is provided a closed heat transfer system which is capable of providing more efficient heat transfer by virtue of the fact that this system burns for a longer period of time with much less consumption of fuel than does a conventional heating system. The subject closed heat transfer means comprises heat storage means containing a suitable heat storage fluid, a heat source, heat transfer means, a preheater means, hot water feed means, and circulator means. The heat storage means preferably takes the form of a closed container, i.e., heat storage tank, operable in the manner of a vertically standing boiler. The latter boiler is suitably filled with a heat storage fluid such as either water or a more efficient heat sink fluid such as oil. The heat source comprises either a gas-fired or an oil-fired burner, which is mounted adjacent the bottom of the boiler, so as to be operable to heat the heat sotrage fluid contained in the boiler. The heat transfer means comprises a heat transfer coil, which is suitably supported within the boiler so as to extend from the bottom to the top thereof, and so that at least a portion of the heat transfer coil is located in the heat storage fluid. The other portion of the heat transfer coil is supported in heat exchange relation to the preheater means, which preferably takes the form of an external preheater coil. Namely, the preheater coil is mounted in juxtaposed relation to the outer wall of the boiler. Moreover, the preheater coil is cooperatively associated with the hot water feed means and the circulator means. More specifically, the preheater coil has one end thereof which is operatively connected to the input end of the hot water feed means, which in turn may take the form of a conventional home hot water heating system consisting of suitable piping which is located along the baseboard in each room of the building which is to be heated. The other end of the preheater coil is operatively connected to the output end of the circulator means whereby the preheater coil, the hot water feed means and the circulator means function to form a closed circuit hot water heating system.

DESCRIPTION OF THE PREFERRED EMBODIMENT

Figure 1:
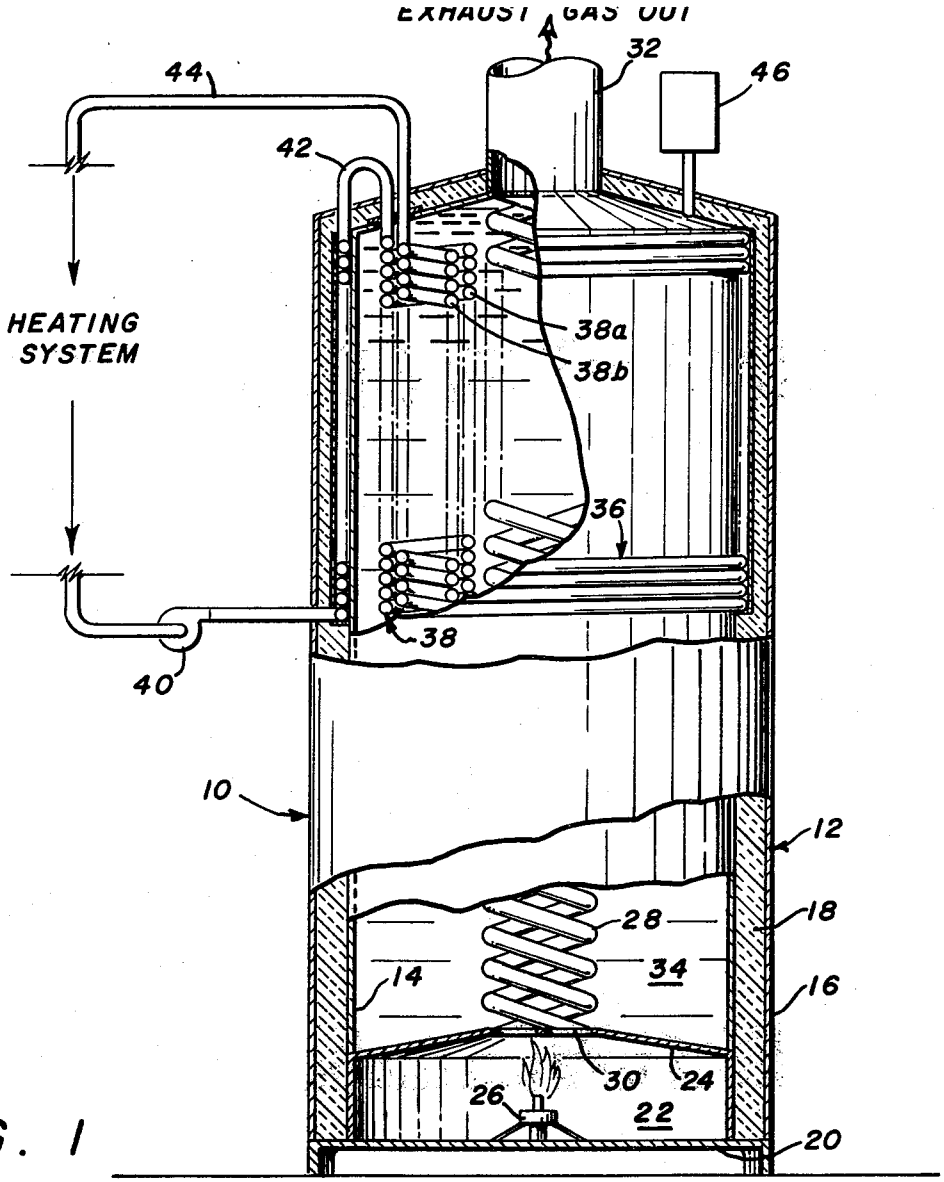
FIG. 1 is a side elevational view with parts broken away for purposes of clarity of illustration of one embodiment of a closed heat transfer system constructed in accordance with the present invention.

Referring now to the drawing, and more particularly FIG. 1 thereof, there is depicted a closed heat transfer system, generally designated by reference numeral 10, constructed in accordance with a preferred embodiment of the present invention. The closed heat transfer system includes a heat storage means 12 comprising a vertically standing, generally cylindrical heat storage tank. Tank 12 is operative in the manner of a boiler as will be described more fully hereinafter. The heat storage tank 12 includes an inner wall 14 suitably spaced from an outer wall 16. In accordance with the illustrated embodiment of the heat storage tank 12, the space between the inner and outer walls 14 and 16 thereof is preferably filled with a suitable insulative material 18 such as fiberglass.

Continuing with a description of the heat storage tank 12, the latter is preferably supported, as depicted in FIG. 1, on a suitably configured base 20. The base 20 may either be formed integrally as a part of the heat storage tank 12, or is so desired the base 20 may comprise a separate structure to which the heat storage tank 12 is detachably secured. Completing the description of the heat storage tank 12, a suitably dimensioned chamber 22 is preferably formed adjacent the bottom end portion of the tank 12. More specifically, the chamber 22 is formed by the base 20, the inner wall 14 of the heat storage tank 12 and a member 24 which spans the interior of the heat storage tank 12 intermediate the inner wall 14 thereof. The chamber 22 forms a compartment in which a burner 26 is suitably supported approximately at the center thereof. Inasmuch as the burner 26 is of conventional construction, it is not deemed necessary to describe the burner 26 in detail herein. The burner 26 may either be oil-fired or gas-fired. In addition, suitable access means, not shown in the interest of maintaining clarity of illustration in the drawing, is formed in the base 20 so as to enable the fuel required to fire the burner 26 to be fed thereto.

Referring again to FIG. 1 of the drawing, a heat transfer means 28 in the form of a spiral vent tube extends substantially the length of the interior of the heat storage tank 12. One end of the spiral vent tube 28 is sutably secured in juxtaposed relation to an opening 30 formed at the center of the member 24 for a purpose yet to be described. The other end of the spiral vent tube 28 is suitably secured at the top of the heat storage tank 12 so as to be in communication with an exhaust stack 32, with which the closed top portion of the heat storage tank 12 is provided.

The heat storage tank 12 is filled with a suitable heat storage fluid 34, i.e., heat exchange medium. Inasmuch as the fluid 34 in the heat storage tank 12 does not circulate from the tank 12 in contradistruction to conventional forms of heating systems, the fluid 34 which is to be used in the tank 12 may be selected on the basis of its heat exchange characteristics. Whereas in many conventional forms of heating systems the heat exchange medium which is heated is water, the closed heat transfer system 10 of the present invention is not limited to the use of water as the heat exchange medium 34. A fluid such as oil which is a more efficient heat sink fluid than is water can thus be utilized as the heat exchange medium 34 in the heat storage tank 12.

The function of the previously described burner 10 is to heat the heat exchange medium 34 to a predetermined temperature, whereupon the medium 34, because of its ability to serve as a heat sink, retains the heat added thereto for a significant period of time. Heat from the burner 26 is imparted to the heat exchange medium 34 in a dual fashion. First, the heat exchange medium 34 is heated directly from the flame of the burner 26. Secondly, the heat of the exhaust gas generated from the flame of the burner 26, which would normally be lost, is made to pass through the spiral vent tube 28, which was described previously hereinabove. As the exhaust gas flows through the spiral vent tube 28 before existing from the latter into the stack 32, the heat of the exhaust gas is transferred therefrom to the heat exchange medium 34 which surrounds the spiral vent tube 28. Because the spiral vent tube 28 takes the form of several tubes, there is provided more surface area through which the heat exchange function can be affected. Moreover, because the vent tube 28 is in the form of a spiral rather than a straight stack, the exhaust gas from the burner 26 is made to pass through a much greater distance before exiting from the heat storage tank 12 thereby enabling the heat exchange function to be carried out from the exhaust gas to the heat storage fluid 34 for a much longer period of time.

With further reference to FIG. 1 of the drawing, the heat storage tank 12, in the upper portion thereof, is provided with a preheater means 36. The preheater means 36 preferably takes the form of an external preheater coil consisting of a multiplicity of turns around the exterior of the inner wall 14 of the heat storage tank 12. As can be seen with reference to FIG. 1, a lesser amount of fiberglass 18 is provided between the inner wall 14 and the outer wall 16 of the heat storage tank 12 in the upper half of the latter whereby to provide space for positioning the preheater coil 36 therebetween. Namely, the preheater coil 36 is supported so as to be in juxtaposed relation to the outer surface of the inner wall 14, and between the latter and the insulative material 18. Preferably a layer of reflective material (not shown) is placed between the preheater coil 36 and the insulative material 18. The afore-referenced layer of reflective material has been omitted from the drawings in the interest of clarity of illustration.

Continuing with the description of the closed heat transfer system 10 of FIG. 1, the latter further includes a hot water feed means 38, which along with the previously described preheater means 36 and the as yet to be described circulator means 40 comprises the heating system portion of the closed heat transfer system 10.

The hot water feed means 38 has its input end operatively connected to the output end of the preheater coil 36 through the use of any suitable conventional form of connecting means. The latter connecting means is accord with the illustrated form thereof comprises a short, inverted, U-shaped length of pipe 42. The hot water feed means 38 itself consists in accord with the embodiment of the invention illustrated in FIG. 1 of two concentric coils 38*a* and 38*b*, respectively, of piping. The input to the hot water feed means 38 is through the outer coil 38*a* while the output from the hot water feed means 38 is accomplished from the inner coil 38*b* in a manner which will now be described.

The medium which is to serve as the building heat transfer fluid flows in a closed loop through the preheater coil 36, the hot water feed means 38 and the circulator means 40. In accord with the preferred embodiment of the invention of FIG. 1, this medium comprises hot water. The hot water enters the preheater coil 36 at the lower end thereof. As the water circulates through the preheater coil 36 it is heated by virtue of thermal exchange with the heat storage fluid 34 which fills the heat storage tank 12. After the water completes its passage through the preheater coil 36 it exits from the latter through the inverted U-shaped length of pipe 42, and enters the outer coil 38*a* of the hot water feed means 38. At this point it should be noted that the hot water feed means 38 is suitably supported through the use of any conventional form of support means (not shown) so as to be immersed in the heat storage fluid 34 contained in the heat storage tank 12 whereby the heat of the heat storage fluid 34 is operative to effect a heating of the water flowing through the concentric coils 38*a* and 38*b*. From the outer coil 38*a* of the hot water feed means 38, the water flows into the inner coil 38*b* thereof and eventually exits from the hot water feed means 38 into the piping 44.

To complete the description of the closed heat transfer system 10, the latter further includes circulator means 40. The circulator means 40 preferably consists of a water circulation pump which is operative to effect the circulation of the water through the preheater coil 36, the U-shaped length of pipe 42, the hot water feed means 38, and the piping 44. The circulator means 40 moreover is preferably connected in fluid circuit relation along the length of the piping 44, and more specifically adjacent the end of the piping 44 which is connected to the input end of the preheater coil 36.

Finally, in accord with the illustrated embodiment of the closed heat transfer system 10, provision is preferably made for providing the heat storage tank 12 with an expansion tank 46. The latter expansion tank 46 is suitably mounted through the use of any conventional form of mounting means (not shown) on the top of the heat storage tank 12 so as to communicate with the interior of the heat storage tank 12. The expansion tank 46 is operative in the event of an undesired buildup of pressure within the heat storage tank 12 to permit a relief of this excessive pressure by permitting an expansion within the expansion tank 46 of the medium contained in the heat storage tank 12.

Briefly summarizing the mode of operation of the closed heat transfer system 10 of FIG. 1, the heat storage tank 12 is filled with a suitable heat storage fluid 34. The burner 26 is then fired whereby to effect a heating of the heat storage fluid 34. The burner 26, when compared to conventional heating systems, burns for a longer period of time with much less consumption of fuel, giving time for more heat transfer; i.e., burner 26 is substantially equivalent to a pilot in a conventional boiler. The heat storage fluid 34 has no exchange of fluid as commonly occurs in a conventional boiler. Moreover, the heat storage fluid 34 can be either water or a more efficient heat sink fluid such as oil, which provides two and one-half times the heat retention of water and absorbs heat faster. In addition, oil protects the heat storage tank 12 from rust, etc. Because there is no transfer of fluid in the heat storage tank 12, the heat storage fluid 34 stays calm other than for its own movement from thermals caused by heating or by heat absorption from the conducting coil. Furthermore, since the heat storage storage fluid 34 in the heat storage tank 12 does not circulate, the heat storage tank 12 has no disturbing movement from air bubbles caused by circulating water pumps, and other disturbances caused by water moving through long pipes, heat expansion, etc. Finally, pressure can be applied to the heat storage tank 12 other than through heat expansion to give greater heat transfer efficiency.

Continuing with the brief summarization of the mode of operation of the closed heat transfer system 10 of FIG. 1, a closed loop heating system consisting of the preheater coil 3, the U-shaped pipe 42, the hot water feed means 38, the piping 44 and the circulator means 40 is embodied within the closed heat transfer system 10. The hot water feed means 38 is immersed within the heat storage fluid means 34 so that as water circulates through the former it is heated by the heat retained by the latter. After being heated as the water flows through both the preheater coil 36 and the hot water feed means 38, the water is circulated by the circulator means 40 through the piping 44 to the areas of the building structure, which are designed to be heated by the closed heat transfer system 10.

Figure 2:
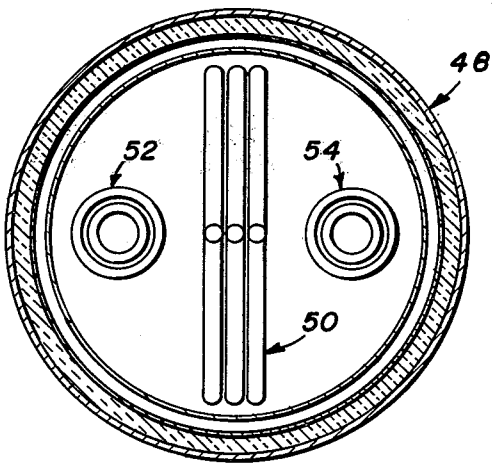
FIG. 2 is a top plan view of a second embodiment of a closed heat transfer system constructed in accordance with the present invention.

Turning now to FIG. 2 of the drawing, there is depicted therein a second embodiment of closed heat transfer system, generally designated by reference numeral 48, constructed in accordance with the present invention. The closed heat transfer system 48 differs from the closed heat transfer system 10 of FIG. 1 essentially simply by virtue of the fact that the former embodies elongated vent tubes 50 rather than the spiral vent tubes 28 of the latter. In addition, the closed heat transfer system 48 of FIG. 2 is provided with tankless coils 52 and 54. Other than these above-described structural changes, the closed heat transfer system 48 embodies the same construction and functions in the same manner as the closed heat transfer system of FIG. 1. Consequently, it is not deemed necessary to describe the nature of the construction of the mode of operation of the closed heat transfer system 48 of FIG. 2 in greater detail herein.

Thus, in accordance with the present invention there has been provided a novel and improved closed heat transfer system of the type which is operative as a heating system for building structures. The present invention is characterized in that the medium being heated by the heat source and the medium being circulated in the piping may be different. In accordance with the preferred form of the invention, a closed heat transfer system has been provided which is capable of utilizing all of the available or otherwise wasted heat. The closed heat transfer system of the present invention is further characterized in that because of the efficiency thereof the boiler temperature cools very slowly thereby making possible several circulating cycles before the boiler temperature cools down to a sufficient degree before some heat is called for. In addition, the closed heat transfer system of the present invention makes possible a lower average boiler temperature thereby providing for a greater absorption rate potential between the boiler and the heat source. Moreover, in accord with the present invention a closed heat transfer system is provided which provides for an even transfer of boiler heat thereby preventing cold spots or cold return, and as a consequence prevents unneeded boiler startups. Finally, the closed heat transfer system of the present invention is relatively simple in construction, easy to employ, and relatively inexpensive to provide.

While only two embodiments of our invention have been shown, it will be appreciated that modifications thereof, some of which have been noted in the preceding description, may readily be made by those skilled in the art. The appended claims are thus intended to cover the modifications specifically referred to herein as well as all other modifications which fall within the true spirit and scope of the invention.

What is claimed is:

1. A source of thermal energy for a closed heat transfer system which is operative as a heating system for a building structure comprising:

(a) heat storage means for storing heat therein;

(b) a heat source mounted in juxtaposed relation to said heat storage means and operative as a source of heat for said heat storage means;

(c) heat transfer means supported within said heat storage means and operative to effect the transfer of waste heat from said heat source to said heat storage means;

(d) preheater means supported in juxtaposed relation to said heat storage means for receiving heat from said heat storage means;

(e) fluid feed means supported in said heat storage means for receiving heat from said heat storage means, said fluid feed means being connected in fluid flow relation with said preheated means; and (f) circulator means operative to effect the circulation of fluid through said preheater means and said fluid feed means with the fluid being heated as the fluid circulates through said preheater means and said fluid feed means.

2. The apparatus of claim 1 wherein said heat storage means includes a heat storage tank operative as a boiler.

3. The apparatus of claim 2 wherein said heat storage means further includes a heat storage medium contained in said heat storage tank.

4. The apparatus of claim 3 wherein said heat storage medium comprises oil.

5. The apparatus of claim 1 wherein said heat source comprises a fuel-fired burner.

6. The apparatus of claim 1 wherein said heat source is a combuster and wherein said heat transfer means comprises at least one vent tube supported in said heat storage means so as to be in contact with a heat storage medium therein, said tube extending the length of said heat storage means and so as to have one end thereof located in juxtaposed relation to said heat source to receive exhaust products therefrom.

7. The apparatus of claim 1 wherein said fluid feed means comprises a pair of interconnected concentric coils immersed in said heat storage means, said pair of interconnected concentric coils having the input end thereof operatively connected to said preheater means and having the output end thereof operatively connected to a heating system.

8. The apparatus of claim 1 wherein said preheater means comprises a preheater coil mounted in external relation to said heat storage means, said preheater means having the input end thereof operatively connected to said circulator means and the output end thereof operatively connected to said fluid feed means.

9. The apparatus of claim 1 wherein said circulator means comprises a circulating pump.

10. The apparatus of claim 6 wherein said vent tube is a spiral tube.

11. The apparatus of claim 6 wherein said preheater means comprises a preheater coil mounted in external relation to said heat storage means, said preheater means having the input end thereof operatively connected to said circulator means and the output end thereof operatively connected to said fluid feed means.

12. The apparatus of claim 11 wherein said fluid feed means comprises a pair of interconnected concentric coils immersed in said heat storage means, said pair of interconnected concentric coils having the input end thereof operatively connected to said preheater means and having the output end thereof operatively connected to a heating system.

* * * * *